US008326202B2

(12) United States Patent
Mitsunobu

(10) Patent No.: US 8,326,202 B2
(45) Date of Patent: Dec. 4, 2012

(54) TONER CONVEYING MECHANISM, CLEANING DEVICE AND IMAGE FORMING APPARATUS

(75) Inventor: Hidetaka Mitsunobu, Tokyo (JP)

(73) Assignee: Oki Data Corporation, Tokyo (JP)

( * ) Notice: Subject to any disclaimer, the term of this patent is extended or adjusted under 35 U.S.C. 154(b) by 347 days.

(21) Appl. No.: 12/235,770

(22) Filed: Sep. 23, 2008

(65) Prior Publication Data

US 2009/0080946 A1 Mar. 26, 2009

(30) Foreign Application Priority Data

Sep. 25, 2007 (JP) ..... 2007-247865

(51) Int. Cl.
*G03G 21/00* (2006.01)

(52) U.S. Cl. ..... 399/358; 399/350

(58) Field of Classification Search ..... 399/358
See application file for complete search history.

(56) References Cited

U.S. PATENT DOCUMENTS

| | | | | |
|---|---|---|---|---|
| 4,982,240 | A * | 1/1991 | Nakano | 399/358 |
| 6,832,067 | B2 * | 12/2004 | Kubo | 399/350 |
| 2005/0249533 | A1 * | 11/2005 | Suda et al. | 399/358 |
| 2006/0024100 | A1 * | 2/2006 | Ohta et al. | 399/350 |

FOREIGN PATENT DOCUMENTS

| | | | |
|---|---|---|---|
| JP | 63197978 | A | 8/1988 |
| JP | 01262577 | A | 10/1989 |
| JP | 02032382 | A | 2/1990 |
| JP | 06-222704 | A | 8/1994 |
| JP | 06222704 | A * | 8/1994 |
| JP | 07253741 | A | 10/1995 |
| JP | 2002278401 | A | 9/2002 |

* cited by examiner

*Primary Examiner* — Walter L Lindsay, Jr.
*Assistant Examiner* — David Bolduc
(74) *Attorney, Agent, or Firm* — Panitch Schwarze Belisario & Nadel LLP

(57) ABSTRACT

A cleaning device including a toner conveying mechanism is provided. The toner conveying mechanism includes a conveying member that rotates to convey toner, an elastic member configured to contact a circumference of the conveying member, an image carrying body, and a cleaning member disposed between the elastic member and the image carrying body. The elastic member slidingly contacts the circumference of the rotating conveying member.

24 Claims, 11 Drawing Sheets

| BENT ANGLE ( $\alpha$ ) | 0 | 15 | 30 | 45 | 60 | 75 |
|---|---|---|---|---|---|---|
| PAPER DIRT | × | △ | ○ | ○ | ○ | ○ |
| BENT ANGLE ( $\alpha$ ) | 95 | 105 | 120 | 135 | 150 | 165 |
| PAPER DIRT | ○ | ○ | ○ | ○ | ○ | △ |

*FIG. 5*

| COMPONENT | COMPARISON EXAMPLE 1 | EXPERIMENT EXAMPLE 2-1 | EXPERIMENT EXAMPLE 2-2 |
|---|---|---|---|
| LOAD ( N · cm ) | 8 | 7 | 7 |
| WHITE PAPER DIRT | ○ | ○ | × |

*FIG. 7*

| PRINT SHEETS (TEN THOUSAND SHEETS) | | 2 | 2.5 | 3 |
|---|---|---|---|---|
| COMPONENT | COMPARISON EXAMPLE 1 | ○ | × | × |
| | COMPARISON EXAMPLE 2 | ○ | × | × |
| | EXPERIMENT EXAMPLE 3 | ○ | ○ | ○ |

*FIG. 11*

TONER CONVEYING MECHANISM, CLEANING DEVICE AND IMAGE FORMING APPARATUS

FIELD OF THE INVENTION

The invention relates to a toner conveying mechanism that is used in an image forming apparatus such as electrographic copying apparatus or printer, removes and collects remainder toner remaining on surface of an image carrying body and conveys the collected remainder toner; relates to a cleaning device having the toner conveying mechanism and relates to an image forming apparatus having the cleaning device.

BACKGROUND OF THE INVENTION

Conventionally, a kind of the cleaning device is proposed, for example, as disclosed in a patent document 1, which has toner conveying mechanism, when remainder toner remaining on the surface of image carrying body is scraped to be removed by a cleaning blade and the scraped remainder toner is collected by a remainder toner collecting section, that conveys the remainder toner to a waste toner accommodating section by rotation of a conveyance coil that is furnished in the remainder toner collecting section.

By the way, in the cleaning device, there is a case that the remainder toner that is scraped from the image carrying body by the cleaning blade is stuck to the blade. For preventing such adhesion, conventionally, the whole remainder toner collecting section is given vibration to drop the remainder toner that is stuck to the cleaning blade and the remainder toner is conveyed to the waste toner accommodating section by using the conveyance coil.

Patent document 1: Japan patent publication 6-222704.

SUMMARY OF THE INVENTION

A first aspect of the invention is to provide a toner conveying mechanism. The toner conveying mechanism comprises a conveying member that rotates to convey toner; and an elastic member that is furnished for contacting with circumference of the conveying member, wherein the elastic member slidably contacts to circumference of the conveying member that is rotating.

A second aspect of the invention is to provide a cleaning device. The cleaning device comprises a toner conveying mechanism, wherein the toner conveying mechanism includes: a conveying member that rotates to convey toner; and an elastic member that is furnished for contacting with circumference of the conveying member, wherein the elastic member slidably contacts to circumference of the conveying member that is rotating.

A third aspect of the invention is to provide an image forming apparatus. The image forming apparatus comprises a cleaning device, wherein the cleaning device comprises a toner conveying mechanism, wherein the toner conveying mechanism includes a conveying member that rotates to convey toner; and an elastic member that is furnished for contacting with circumference of the conveying member, wherein the elastic member slidably contacts to circumference of the conveying member that is rotating.

EFFECT OF THE PRESENT INVENTION

According to the invention, as an means to prevent an adhesion of remaining toner in a removing member, through an elastic member is furnished to contact with a circumference of a conveying member along the removing member, because the elastic member vibrates by repeatedly contacting with the circumference of the conveying member with a rotation of the conveying member, so it contacts with the remainder toner adhered to the removing member and breaks up the reminder toner, then, the elastic member can drop the remainder toner into the outside of the collecting section when the elastic member is vibrating.

The above and other objects and features of the present invention will become apparent from the following detailed description and the appended claims with reference to the accompanying drawings.

BRIEF DESCRIPTION OF THE DRAWINGS

FIG. 5 is a diagram for showing a result concerning an optimum angle evaluation of bend angle of a L-type film in an image forming apparatus of embodiment 1;

FIG. 7 is a diagram for showing a result concerning an optimum thickness evaluation of thickness of a L-type film in image forming apparatus of embodiment 2;

FIG. 11 is a diagram for showing a result concerning an accuracy evaluation of an image forming apparatus of embodiment 3.

DETAILED DESCRIPTION OF THE PREFERRED EMBODIMENTS

Embodiments of the invention will be described in detail hereinbelow with reference to the drawings.

Embodiment 1

Structure of Embodiment 1

Figure 3:
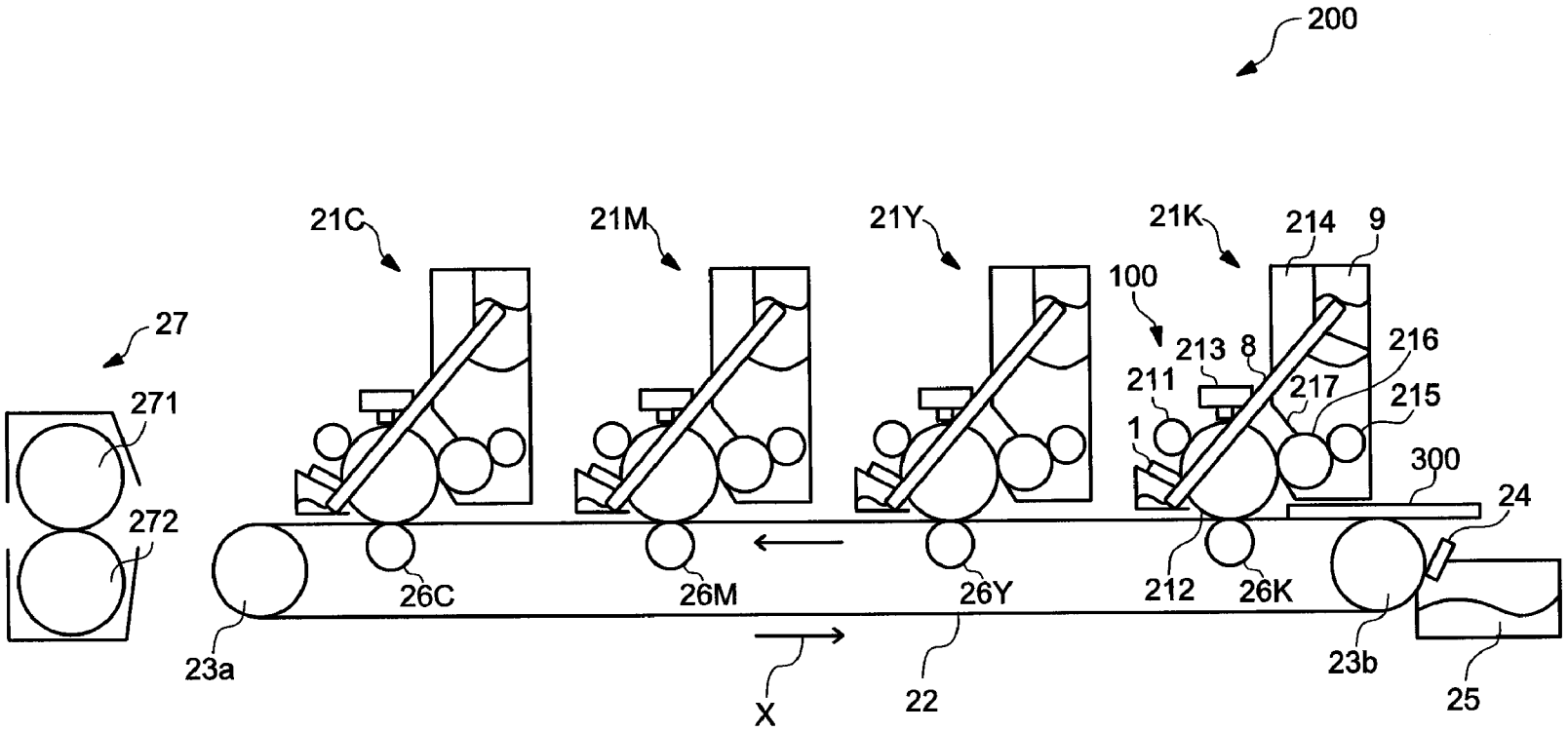
FIG. 3 is a diagram for showing a structure of an image forming apparatus having a cleaning device in embodiment 1.

An image forming apparatus 200 of embodiment 1 of the present invention, is a printer as shown by FIG. 3, comprises image forming units 21K, 21Y, 21M, 21C that respectively have a cleaning device 100 (mentioned below) of the present invention, a transfer belt 22, a driving roller 23*a* and 23*b*, a transfer belt cleaning blade 24, a transfer belt remainder toner accommodating section 25, a transferring rollers 26K, 26Y, 26M, 26C and an image fixing unit 27.

Further, the image forming apparatus 200 is connected with a higher rank apparatus (not shown) such as PC (Personal Computer) through network, and performs a control of the whole apparatus such as a supply of voltage from a power source section (not shown) to each section, a drive of each motor (not shown) for rotating each roller, a print control based on information from each sensor through using a controlling section (not shown) that is formed from a micro computer and the like.

The image forming unit 21K is a mechanism for forming toner image of black (K) color, as shown by FIG. 3, is composed of a cleaning device 100, a charging roller 211, a photosensitive body drum 212, a LED head 213, a toner tank 214 holding the toner of the black color, a toner supplying roller 215, a developing roller 216 and a layer formation blade 217.

The image forming unit 21Y is a mechanism for forming toner image of yellow (Y) color, and has the same structure as the image forming unit 21K except that it holds the toner of yellow color in the toner tank 214.

The image forming unit 21M is a mechanism for forming toner image of magenta (M) color, and has the same structure as the image forming unit 21K except that it holds the toner of magenta color in the toner tank 214.

The image forming unit 21C is a mechanism for forming toner image of cyan (C) color, and has the same structure as the image forming unit 21K except that it holds the toner of cyan color in the toner tank 214.

Here, the toner of each color that is held in each toner tank 214 of the image forming units 21K, 21Y, 21M, 21C, is formed by polyester resin (glass transfer temperature Tg=40° C.), coloring agent, charge control agent and mold release agent; is added external additive agent (hydrophobic silica); and is developer whose average sphere diameter of grind shape that was got by crushing method is 8 μm. Further, the image forming units 21K, 21Y, 21M, 21C can be attached to the apparatus body of the image forming apparatus or removed from the apparatus body of the image forming apparatus 200.

The image fixing unit 27 is a mechanism of fixing the toner image on a print medium 300, as shown by FIG. 3, is formed from a heating roller 271 and a pressurizing roller 272. Here, the heating roller 271 has a heater (not shown) in the roller for heating the heating roller 271.

After image data is obtained from the higher rank apparatus that is connected with the image forming apparatus 200 via network through an I/F (Inter/Face) section (not shown) of the image forming apparatus 200, the image data is stored into a image memory (not shown) by the control of the controlling section (not shown). Here, the I/F section is a communicating section that performs a receiving of the image data from the higher rank apparatus and notification of a process result of the received image data; is a serial interface such as USB (Universal Serial Bus) or a parallel interface such as IEEE1284; and is connected with the higher rank apparatus in a predetermined protocol of each interface.

After a user sets up a manuscript on a reading section (not shown) of the image forming apparatus 200 and instructs to print through button furnished in an inputting section (not shown), the reading section reads the manuscript and generates the image data. After the reading section generates the image data, the image data is stored into the image memory (not shown) by the control of the controlling section (not shown).

After the image data is stored in the image memory, a paper feeding roller (not shown) is rotated by the control of the controlling section (not shown), the paper feeding roller feeds the print medium 300 held on the most top in a paper tray (not shown). By this, the paper feeding roller conveys the print medium 300.

The paper feeding roller feeds the print medium 300; and a conveying roller (not shown) is rotated by the control of the controlling section (not shown). By this, the print medium 300 is conveyed while being sandwiched between the conveying roller and the pressing roller (not shown) which is furnished opposite to the conveying roller.

When the tip of the print medium 300 that is conveyed while being sandwiched between the conveying roller and the pressing roller reaches a passage sensor (not shown), respective photosensitive body drums 212 of the image forming units 21K, 21Y, 21M, 21C and the driving roller 23*a* and 23*b* are rotated by the control of the controlling section (not shown).

When the photosensitive body drum 212 of the image forming unit 21K rotates, the charging roller 211 charges the surface of the photosensitive body drum 212 by the control of the controlling section (not shown).

When the surface of the photosensitive body drum 212 is charged, for example, the LED head 213 which is formed by arranging LED (Light Emitting Diode) array emits light by the control of the controlling section (not shown) and forms the electrostatic latent image on the surface of the charged photosensitive body drum 212 on the basis of the image data held in the image memory.

When the electrostatic latent image is formed on the surface of the photosensitive body drum 212, the toner of the black color held in the toner tank 214 is supplied to the surface of the developing roller 216 through the toner supplying roller 215 by the control of the controlling section.

The layer formation blade 217 is used for regulating and uniforming the layer thickness of the toner (toner layer thickness) on the developing roller 216. While the toner of the surface of the developing roller 216 passes the layer formation blade 217, the toner layer thickness is regulated to become almost uniform layer thickness by a shear force of the layer formation blade 217.

When the surface of the developing roller 216 which is stuck by the toner that is regulated to have an almost uniform layer thickness, touches the surface of the photosensitive body drum 212, the electrostatic latent image on the photosensitive body drum 212 is developed through using the toner. By this, the toner image of the black color corresponding to the electrostatic latent image is formed as a visible image on the surface of the photosensitive body drum 212.

Likewise, respective toner images of yellow, magenta, cyan colors corresponding to the electrostatic latent image are formed as visible images on the surfaces of respective photosensitive body drums 212 of respective image forming unit 21K, 21Y, 21M, 21C.

When the driving roller 23*a* and 23*b* rotates, the transfer belt 22, as shown by FIG. 3, moves along the direction X. Then, the print medium 300 is conveyed by the transfer belt 22, and is conveyed while being sandwiched and held by the photosensitive body drum 212 and the transferring roller 26K. By this, the controlling section (not shown) controls the transferring roller 26K that is supplied with high voltage outputted from the power source section (not shown) to transfer the toner image on the surface of the photosensitive body drum 212 on the print medium 300.

After the toner image on the surface of the photosensitive body drum 212 was transferred on the print medium 300, the remainder toner 400 remaining on the surface of the photosensitive body drum 212 is scraped to be removed by the cleaning device 100 (mentioned below).

Likewise, the controlling section (not shown) controls the respective transferring rollers 26Y, 26M, 26C that are supplied with high voltage outputted from the power source section (not shown) to transfer the toner images of respective colors on the print medium 300, the toner images are formed in respective image forming units 21Y, 21M, 21C. And, likewise, the remainder toner 400 remaining on the surfaces of the respective photosensitive body drums 212 in the respective image forming units 21Y, 21M, 21C, is scraped to be removed by the respective cleaning devices 100 in the respective image forming units 21Y, 21M, 21C.

At the time that the toner image on the surface of the photosensitive body drum 212 is transferred on the print medium 300, the controlling section (not shown) controls the heater (not shown) that was furnished in the heating roller 271 to heat the surface of the heating roller 271 to a predetermined temperature. Here, by the control of the controlling section (not shown), the heater is supplied a predetermined voltage from the power source section (not shown) and is heated.

Then, when the print medium 300 on which the toner image is transferred is conveyed while being sandwiched between the heating roller 271 whose surface was heated to the predetermined temperature and the pressurizing roller 272 which is furnished opposite to the heating roller 271, the toner image on the print medium 300 is heated and pressurized by the heating roller 271 and the pressurizing roller 272 and is fixed on the print medium 300.

The print medium 300 that was processed to fix by the heating roller 271 and the pressurizing roller 272 is conveyed while being sandwiched by a rotating ejecting roller (not shown) and the pressing roller (not shown) that is furnished opposite to the ejecting roller, and is ejected from an ejection opening (not shown) of the image forming apparatus 200. By this, the print process with respect to one sheet of print medium 300 in the image forming apparatus 200 is completed.

When the toner image on the surface of the photosensitive body drum 212 was transferred on the print medium 300, the remainder toner 400 that adhered on the transfer belt 22, for example, because of a protrusion of the toner from the print medium 300, is scraped to be removed by the transfer belt cleaning blade 24 that was furnished in the location contacting with the driving roller 23*a* through the transfer belt 22 (FIG. 3), and is collected into the transfer belt remainder toner accommodating section 25.

Figure 1:
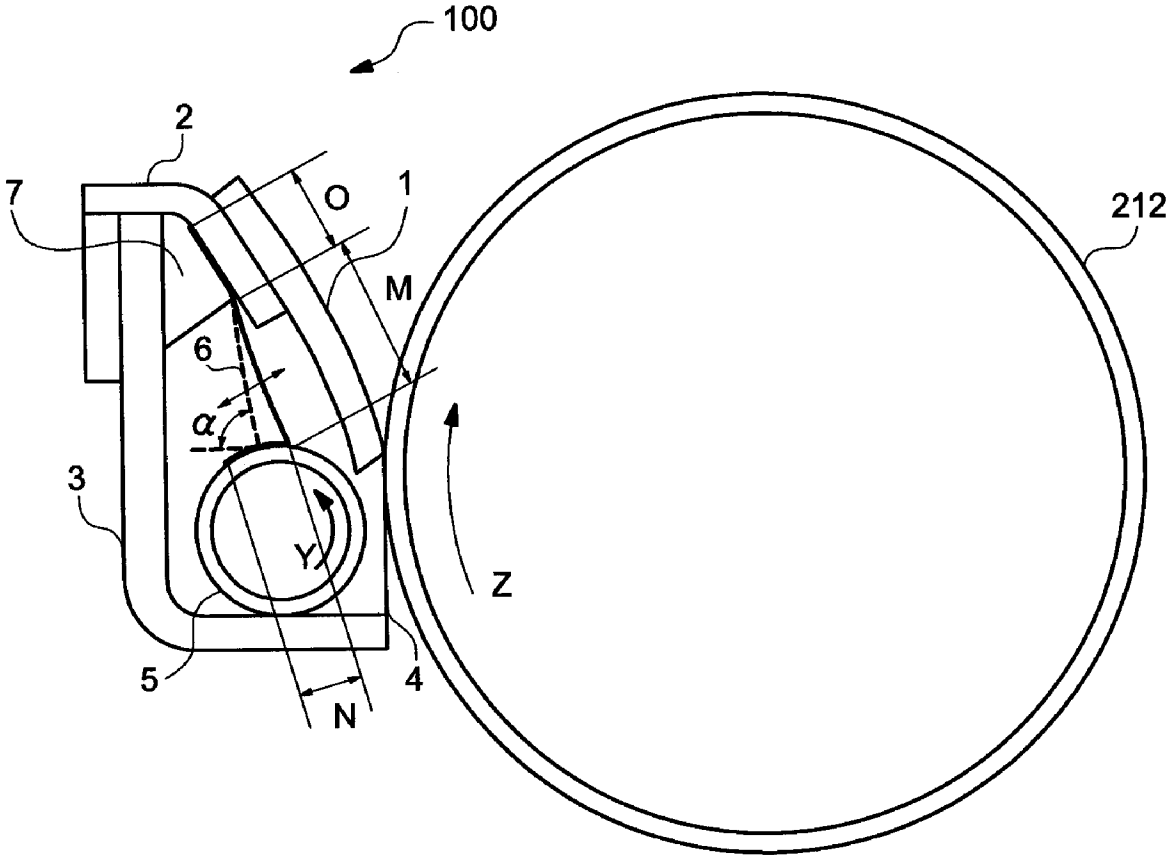
FIG. 1 is a cross section diagram of the front view for showing a structure of a cleaning device in embodiment 1.

The cleaning device 100 including the toner conveying mechanism conveying the toner, as shown by FIG. 1, is composed of a cleaning blade 1 for scraping the remainder toner 400 remaining on the surface of the photosensitive body drum 212 that was furnished in the image forming apparatus 200, a cleaning blade holder 2 for holding the cleaning blade 1, a conveying member cover 3 and a toner leak prevention film 4 for collecting and holding the scraped remainder toner 400, a conveyance coil 5, a L-type film 6, a fixing member 7 for fixing the L-type film 6, a remainder toner conveyance belt 8 (FIG. 2) and a photosensitive body remainder toner accommodating section 9 (FIG. 3).

The cleaning blade 1, as shown by FIG. 1, is used for scraping and removing the remainder toner 400 remaining on the surface of the photosensitive body drum 212 rotating along the direction Z. The cleaning blade 1 is held through making one end of the cleaning blade 1 adhere to the cleaning blade holder 2, and is furnished to make an edge of the other side contact with the surface of the photosensitive body drum 212. After the toner on the surface of the photosensitive body drum 212 was transferred on the print medium 300, the remainder toner 400 remaining on the surface of the photosensitive body drum 212 is scraped to be removed by the contact force of the cleaning blade 1 contacting with the surface of the photosensitive body drum 212.

The remainder toner 400 that was scraped to be removed by the cleaning blade 1, as shown by FIG. 1, is collected in the remainder toner collecting section surrounded by the conveying member cover 3 and the toner leak prevention film 4. Here, the toner leak prevention film 4 is furnished to touch the photosensitive body drum 212, and is stuck and fixed on the underside surface of the conveying member cover 3 by using a two-sided tape.

Figure 4C:
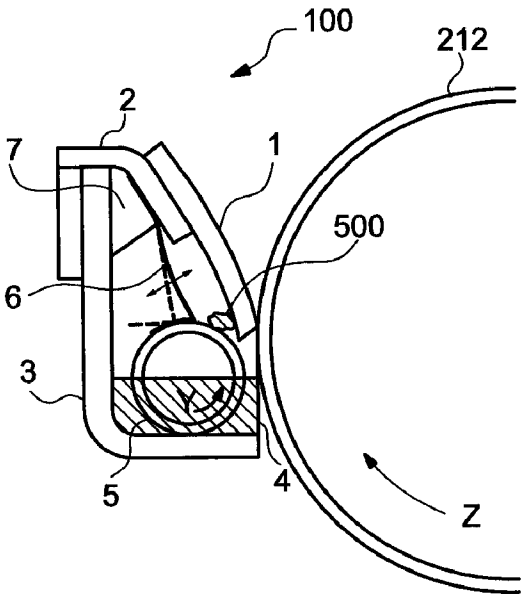
FIG. 4C is a third operation explanation diagram of a L-type film in embodiment 1.
Figure 4B:
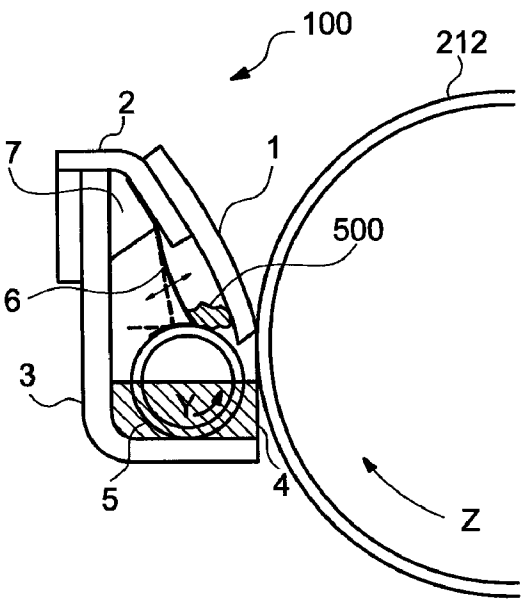
FIG. 4B is a second operation explanation diagram of a L-type film in embodiment 1.
Figure 4A:
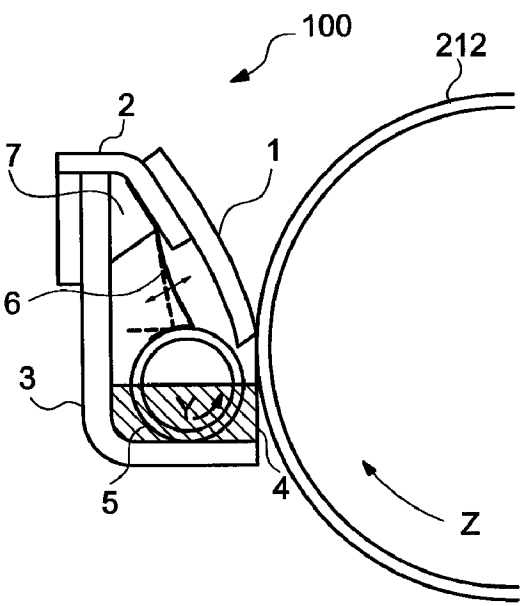
FIG. 4A is a first operation explanation diagram of a L-type film in embodiment 1.

As shown by FIG. 4A, in the case that the remainder toner 400 is scraped to be removed by the cleaning blade 1, the remainder toner 400 drops to the remainder toner collecting section surrounded by the conveying member cover 3 and the toner leak prevention film 4. However, a part of the remainder toner 400, as shown by FIG. 4B, adheres to an inner side of the cleaning blade 1 and becomes a toner lump 500.

Then, as shown by FIG. 4B, in the case to continue to make the toner lump 500 adhere to the inner side of the cleaning blade 1 but not to break the toner lump 500, the cleaning blade 1 is partly pushed upwardly by the toner lump 500. By this, the cleaning blade 1 that was pushed upwardly causes a difference with respect to pressure to press the surface of the photosensitive body drum 212. In the case that the print process is performed by using the cleaning blade 1 having pressure difference, the cleaning blade 1 cannot scrape to remove the remainder toner 400 in the place where the pressure to push the surface of the photosensitive body drum 212 is weak, as a result, paper dirt occurs by the remainder toner 400 when the image forming process is performed with respect to the print medium 300.

The conveyance coil 5, as shown by FIG. 1, is furnished in the remainder toner collecting section surrounded by the conveying member cover 3 and the toner leak prevention film 4, and is used for sending out the remainder toner 400 that is held in the remainder toner collecting section along a direction of the remainder toner conveyance belt 8. The conveyance coil 5 is formed from stainless to serve as a spiral whose circumference (circumference edge) is formed in a spiral shape along a rotational axis direction of the conveyance coil 5. Here, the end part of the conveyance coil 5 is connected with a gear (not shown), is formed by meshing the gear with a gear connecting with the end part of the photosensitive body drum 212. By this, as shown by FIG. 1, because the photosensitive body drum 212 rotates along the direction Z; and the conveyance coil 5 rotates along the direction Y, so the conveyance coil 5 conveys the remainder toner 400 that dropped in the remainder toner collecting section along the direction of the remainder toner conveyance belt 8 by the part whose circumference is formed in spiral shape.

Figure 2:
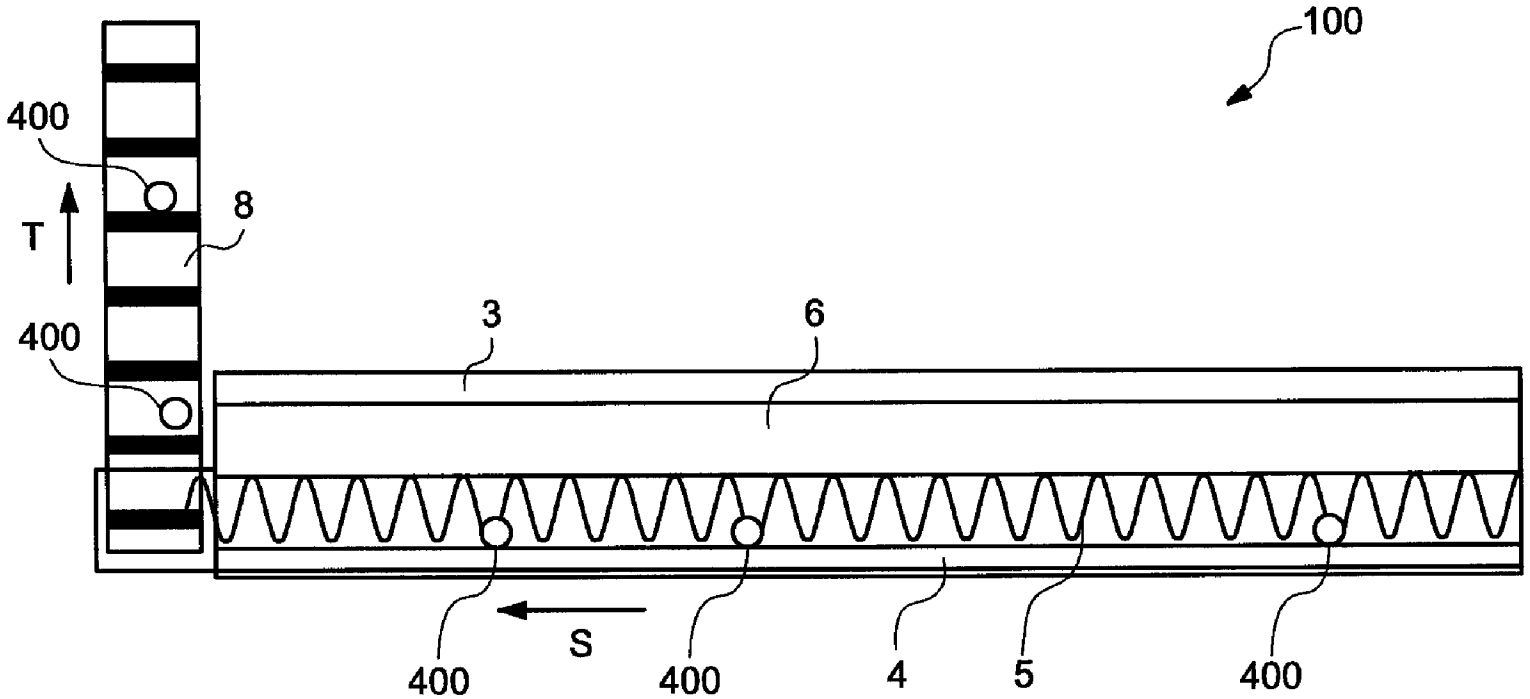
FIG. 2 is a cross section diagram of the side view for showing a structure of a cleaning device in embodiment 1.

The L-type film 6, as shown by FIG. 1 and FIG. 2, is furnished along the length direction of the conveyance coil 5 for contacting with the circumference of the conveyance coil 5, and is used for breaking up the toner lump 500 that adhered to the inner side of the cleaning blade 1. The L-type film 6 is formed from polyester film whose thickness is 0.1 mm. Here, one end (fulcrum) of the L-type film 6 is sandwiched and held by the fixing member 7 and the cleaning blade holder 2, and the L-type film 6 is stuck and fixed at the side of the fixing member 7 by the two-sided tape in the sandwiching and holding portion O. The two-sided tape is stuck to one surface of the sandwiching and holding portion O of the L-type film 6, when the L-type film 6 is stuck onto the fixing member 7, the L-type film 6 is stuck by exfoliating the exfoliation paper.

Moreover, the two-sided tape is not limited by the case stated above, if only it can adhere to the fixing member 7, any tape can be adopted.

Then, the L-type film 6, as shown by FIG. 1, has a bend angle "α" through bending a bend portion N at the side a free end in order to make the L-type film 6 vibrate in an orthogonal direction with respect to the rotation shaft of the conveyance coil 5, the bend portion N is furnished to provide elastic force and contact to the circumference of the conveyance coil 5. Here, the bend direction of the bend portion N of the L-type film 6 is set into the direction alienating from the cleaning blade 1 so that the tip part of the bend portion N does not contact with the cleaning blade 1 even if the L-type film 6 vibrates. Further, a length size of the bend portion N is set in order that the tip part of the bend portion N does not contact with the conveying member cover 3 even if the L-type film 6 vibrates.

Further, in order that the friction between the contact part of the bend portion N of the L-type film 6 and the circumference of the conveyance coil 5 does not become an obstacle (load) to the rotation of the conveyance coil 5, the L-type film is furnished to elastically contact so that the bend amount of the L-type film 6, that is caused by the pressure from the conveyance coil 5 becomes 20% or below with respect to a free length M. In the embodiment 1, the diameter of the conveyance coil 5 is set into 5 mm, the free length M of the L-type film 6 is set into 4.5 mm, the bend portion N of the L-type film 6 is set into 3 mm, the bend amount is set into 0.5 mm, the sandwiching and holding portion O is set into 3 mm and the bend angle "α" of the tip is set into 90 degrees.

Therefore, as shown by FIG. 4A, when the conveyance coil 5 rotates along the direction Y, whenever the L-type film 6 contacts with the conveyance coil 5, the L-type film 6 moves along the direction leaving the cleaning blade 1; leaves the conveyance coil 5 (dotted line location); and returns to the original location (solid line) by its own elastic force. By this, the L-type film 6 vibrates minutely. As shown by FIG. 4B, in the case that the toner lump 500 adheres to the inner side of the cleaning blade 1, as shown by FIG. 4C, the L-type film 6 breaks up the toner lump 500 by a bound force caused by the minute vibration.

The remainder toner conveyance belt 8 is a conveyance belt for conveying the remainder toner 400 of the remainder toner accommodating section stated above to the photosensitive body remainder toner accommodating section 9 that is furnished on the upside of the toner tank 214 as shown by FIG. 3, and wound on a driving roller (not shown). And, when the driving roller rotates by the control of the controlling section (not shown), as shown by FIG. 2, the remainder toner conveyance belt 8 introduces the remainder toner 400 that is conveyed to the direction S from the conveyance coil 5 into the ditch part that is formed on the surface of the remainder toner conveyance belt 8, and moves along the direction T where the photosensitive body remainder toner accommodating section 9 is located. Then, the remainder toner 400 conveyed by the remainder toner conveyance belt 8 is held in the photosensitive body remainder toner accommodating section 9.

Regarding the optimum angle evaluation of the tip bend angle "α" of the L-type film 6 in the embodiment 1 of the present invention, its experiment result is shown in FIG. 5. In the image forming apparatus 200 including the cleaning device 100 having the L-type film 6 with respective bend angles "α", the optimum angle evaluation is based on a result of existence/inexistence of the paper dirt through changing the bend angle "α" per 15 degrees from 0 degree to 165 degrees, in the case that a continuous print of 20 thousands sheets of ordinary paper of A4 is performed in 5% duty (only using the image forming unit 21K having the black toner). Here, the duty is occupying rate of the toner image with respect to the effective print field on the paper (the margin field is excluded); and is equal to image rate. Further, as a result of the optimum angle evaluation, in the item of "paper dirt" of FIG. 5, "○" is stated in the case that the paper dirt is 0 sheet in the print process of 20 thousands sheets; "Δ" is stated in the case that the paper dirt is 100 sheets or below; and "X" is stated in the case that the paper dirt is 100 sheets or over.

In the experiment stated above, it is obvious from an experiment result shown in FIG. 5, in the case that the bend angle "α" of the tip of the L-type film 6 is 0 degree, in a print of 20 thousands sheets, paper dirt of 100 sheets or over occurred. Further, in the case that the bend angle "α" is 15 degrees or 165 degrees, the paper dirt 100 sheets or less occurred. Furthermore, in the case that the bend angle "α" is 30 degrees or over or is 150 degrees or below, the paper dirt does not occur. By this, the optimum angle of the bend angle "α" of the tip of the L-type film 6, is 30 degrees or over or is 150 degrees or below, when the bend angle "α" is set into a value within the range, because the L-type film 6 can break up the toner lump 500 that adheres to the inner side of the cleaning blade 1, as a result, it can perform a print process with high quality and without paper dirt.

Further, when the bend angle "α" is 15 degrees or below, the setting location of the L-type film 6 approaches the inner side of the cleaning blade 1, therefore, the remainder toner 400 that is scraped by the cleaning blade 1 is stuck to the L-type film 6 itself and the toner lump 500 is generated between the L-type film 6 and the inner side of the cleaning blade 1. By this, because the toner lump 500 generated between the L-type film 6 and the inner side of the cleaning blade 1 pushes upwardly the cleaning blade 1, as a result, the paper dirt occurs because of the reason stated above when the image forming process is performed to the print medium 300.

Furthermore, when the bend angle "α" is 165 degrees or over, because the setting location of the L-type film 6 approaches at the side of the conveying member cover 3 and separates from the cleaning blade 1, even if the bend portion N of the L-type film 6 is contacted to the circumference of the conveyance coil 5 and the L-type film 6 vibrates minutely, because the free length M of the L-type film 6 does not reach the toner lump 500 adhering to the inner side of the cleaning blade 1, so, there is a case that the toner lump 500 cannot be broken up. By this, in the image forming apparatus 200, when the L-type film is used, whose bend angle "α" is 165 degrees or over, because the toner lump 500 that adhered to the inner side of the cleaning blade 1 pushes upwardly the cleaning blade 1, as a result, the paper dirt occurs because of the reason stated above when the image forming process is performed to the print medium 300.

Operation of Embodiment 1

The following is to explain operation of the cleaning device 100 of embodiment 1 of the present invention. Here, the bend angle "α" of the L-type film 6 is set into 90 degrees. Moreover, as a reason to set the bend angle "α" into 90 degrees, it is because that the 90 degrees is a middle value in the most suitable angle range of 30 degrees~150, and is judged to be a most suitable value.

After the toner of the surface of the photosensitive body drum 212 was transferred on the print medium 300, the remainder toner 400 remaining on the surface of the photosensitive body drum 212 is scraped to be removed by the contact force of the cleaning blade 1 contacting with the surface of the photosensitive body drum 212.

The remainder toner 400, as shown by FIG. 4A, when scraped to be removed by the cleaning blade 1, drops to the remainder toner collecting section surrounded by the conveying member cover 3 and the toner leak prevention film 4. However, a part of the remainder toner 400, as shown by FIG. 4B adheres to the inner side of the cleaning blade 1 and becomes the toner lump 500.

As shown by FIG. 1, when the photosensitive body drum 212 rotates along the direction Z, the conveyance coil 5 rotates along the direction Y through the gear of the photosensitive body drum 212 meshes the gear of the conveyance coil 5, therefore, the conveyance coil 5 conveys the remainder toner 400 that dropped in the remainder toner collecting section toward the direction of the remainder toner conveyance belt 8.

As shown by FIG. 4A, when the conveyance coil 5 rotates along the direction Y, whenever the L-type film 6 contacts with the conveyance coil 5, the L-type film 6 moves along the direction leaving the cleaning blade 1; leaves the conveyance coil 5 (dotted line location); and returns to the original location (solid line) by its own elastic force. By this, the L-type film 6 vibrates minutely. As shown by FIG. 4B, in the case that the toner lump 500 adheres to the inner side of the cleaning blade 1, as shown by FIG. 4C, the L-type film 6 breaks up the toner lump 500 by a bound force caused by the minute vibration.

When the driving roller for driving the remainder toner conveyance belt 8 rotates by the control of the controlling section (not shown), as shown by FIG. 2, the remainder toner conveyance belt 8 moves; and introduces the remainder toner 400 that is conveyed toward the direction S from the conveyance coil 5 into the ditch part that is formed on the surface of the remainder toner conveyance belt 8, and moves along the direction T where the photosensitive body remainder toner accommodating section 9 is located. Then, the remainder toner 400 conveyed by the remainder toner conveyance belt 8 is held in the photosensitive body remainder toner accommodating section 9.

Effect of Embodiment 1

According to the image forming apparatus 200 of embodiment 1 of the present invention, through the L-type film 6 having the elasticity corresponding to such bend angle "α" whose angle value is 30 degrees or over or is 150 degrees or below is furnished along the length direction of the conveyance coil 5 for contacting with the circumference of the conveyance coil 5, whenever the L-type film 6 contacts with the circumference edges of wings with a rotation of the conveyance coil 5, the L-type film 6 vibrates minutely, therefore, it is possible to breaks up the toner lump 500 adhering to the inner side of the cleaning blade 1 by the bound force caused by the minute vibration, as a result, by the structure that can obtain a low price and can be miniaturized, it is possible to perform a print process with high quality and without paper dirt.

Embodiment 2

A cleaning device 100*a* of embodiment 2 of the present invention comprises a L-type film 6*a* (FIG. 6) that is obtained through forming plural slits 61*a* on a L-type film in order to reduce the pressure toward the conveyance coil 5 from the L-type film along the length direction instead of the L-type film 6 in the cleaning device 100 of embodiment 1. And, an image forming apparatus of embodiment 2 of the present invention has a structure including the cleaning device 100*a*.

The L-type film 6*a* is formed from the same material as the L-type film 6 of embodiment 1, and furnished along the length direction of the conveyance coil 5 to contact with the circumference of the conveyance coil 5. In the L-type film 6*a*, as shown by FIG. 6, the plural slits 61*a* for reducing the pressure toward the conveyance coil 5 from the L-type film 6*a* are provided.

Further, in the L-type film 6*a*, like the L-type film 6 of embodiment 1, whose one end (point of intersection) is sandwiched and held by the fixing member 7 and the cleaning blade holder 2; and is stuck and fixed at the side of the fixing member 7 on the sandwiching and holding portion O by using the two-sided tape. The L-type film 6*a* has a bend angle "α" through bending a bend portion N at the side a free end in order to make the L-type film 6*a* vibrate in an orthogonal direction with respect to the rotation shaft of the conveyance coil 5, the bend portion N is furnished to provide elastic force and contact to the circumference of the conveyance coil 5.

Figure 6B:
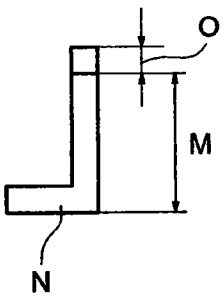
FIG. 6B is a second diagram for showing a structure of a L-type film in embodiment 2.
Figure 6A:
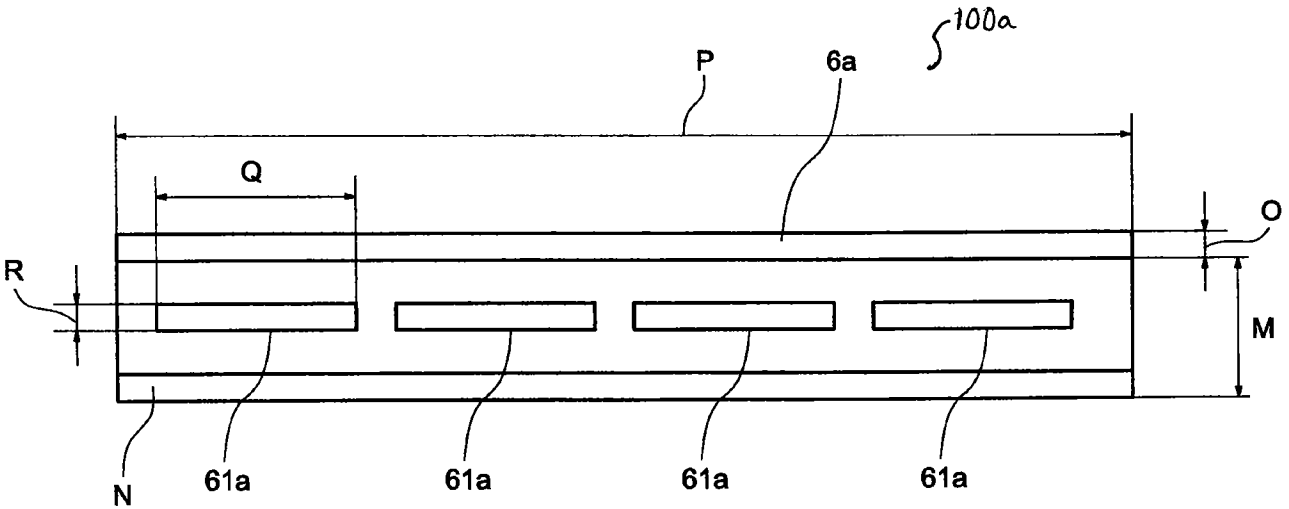
FIG. 6A is a first diagram for showing a structure of a L-type film in embodiment 2.

In the present embodiment 2, as the L-type film 6*a*, as shown by FIG. 6, the length size P is set into 300 mm, the sandwiching and holding portion O is set into 3 mm, the free length M is set into 4.5 mm, the bend angle "α" of the tip is set into 90 degrees, the length measure Q of the slit 61*a* is set into 50 mm and the width size R of the slit 61*a* is set into 2 mm. By this, in the L-type film 6*a* of the present embodiment 2, four slits 61 are furnished equally. Therefore, because the bend amount of the L-type film 6*a* becomes big, it is possible to set the friction force (pressure) with the conveyance coil 5 to be smaller.

The bend direction of the L-type film 6*a*, the same as the L-type film 6 of embodiment 1, is set into the direction alienating from the cleaning blade 1 so that the tip part of the bend portion N does not contact with the cleaning blade 1 even if the L-type film 6 vibrates. Further, the length size of the bend portion N is set in order that the tip part of the bend portion N of the L-type film 6*a* does not contact with the conveying member cover 3 even if the L-type film 6*a* vibrates.

Furthermore, when the conveyance coil 5 rotates along the direction Y, whenever the L-type film 6*a* contacts with the conveyance coil 5, the L-type film 6*a* vibrates minutely, like embodiment 1. In the case that the toner lump 500 adheres to the inner side of the cleaning blade 1, the L-type film 6*a* breaks up the toner lump 500 by the bound force caused by the minute vibration.

Moreover, other components are the same as the components of the cleaning device 100 of embodiment 1 and the image forming apparatus 200 having the cleaning device 100.

Regarding the optimum thickness evaluation of the thickness "t" of the L-type film 6*a* in the embodiment 2 of the present invention, its experiment result is shown in FIG. 7. Here, in the image forming apparatus including the cleaning device 100*a* having the L-type film 6*a* with respective thicknesses "t", the optimum thickness evaluation is based on a result of existence/inexistence of the paper dirt through preparing the L-type films 6*a* of two different thicknesses "t" in the case that a continuous print of 20 thousands sheets of ordinary paper of A4 is performed in 5% duty (only using the image forming unit 21K having the black toner). Here, as a result of the optimum thickness evaluation, in the item of "paper dirt" of FIG. 7, in the case that the paper dirt is 0 sheet in the print process of 20 thousands sheets, "○" is stated; in the case that the paper dirt is 100 sheets or below, "Δ" is stated; and in the case that the paper dirt is 100 sheets or over, "x" is stated.

Further, in the item of "load (N·cm)" of FIG. 7, the load is stated, that is a pressure providing the conveyance coil 5 from the L-type film 6 corresponding to comparison example 1 and respective L-type films 6*a* corresponding to experiment example 2-1 and experiment example 2-2 (stated later). The each load value in FIG. 7 was measured by using load torque gauge PT-1920 (that is manufactured by PROTEC company).

In the "comparison example 1" of FIG. 7, the experiment result of the evaluation of the L-type film 6 (thickness "t" is 0.1 mm) of the present embodiment 1 is shown. Here, in the L-type film 6 whose thickness "t" is 0.1 mm, on the contact surface between the L-type film 6 and the circumference of the conveyance coil 5, the load that is pressure giving the conveyance coil 5 is 8 N·cm. And, in the image forming apparatus 200 including the cleaning device 100 having the L-type film 6, even if 20 thousands sheets of the print medium 300 are performed as print process, the paper dirt did not occur.

In the "experiment example 2-1" of FIG. 7, the experiment result of the evaluation of the L-type film 6*a* (thickness "t" is 0.1 mm) of the present embodiment 2 is shown. Here, in the L-type film 6*a* whose thickness "t" is 0.1 mm, on the contact surface between the L-type film 6*a* and the circumference of the conveyance coil 5, the load that is pressure giving the conveyance coil 5 is 7 N·cm. And, in the image forming apparatus including the cleaning device 100*a* having the L-type film 6*a*, even if 20 thousands sheets of the print medium 300 are performed as print process, the paper dirt did not occur.

In the "experiment example 2-2" of FIG. 7, the experiment result of the evaluation of the L-type film 6*a* (thickness "t" is 0.05 mm) of the present embodiment 2 is shown. Here, in the L-type film 6*a* whose thickness t "t" is 0.05 mm, on the contact surface between the L-type film 6*a* and the circumference of the conveyance coil 5, the load that is pressure giving the conveyance coil 5 is 7 N·cm. And, in the image forming apparatus including the cleaning device 100*a* having the L-type film 6*a*, when 20 thousands sheets of the print medium 300 are performed as print process, the paper dirt of over 100 sheets or over occurred.

On the one hand, according to the result of the optimum thickness evaluation of the comparison example 1, the experiment examples 2-1 and 2-2, with respect to the L-type film 6*a* whose thickness "t" is 0.1 mm or is 0.05 mm, the load that is pressure being given to the conveyance coil 5 was reduced, as compared with the L-type film 6 of embodiment 1. In the L-type film 6*a* whose thickness "t" is 0.05 mm, in a print process with respect to 20 thousands sheets of the print medium 300, the paper dirt of 100 sheets or over occurred. According to the result stated above, it is possible to reduce the load that is pressure being given to the conveyance coil 5 by using the L-type film 6*a* whose thickness "t" is 0.1 mm, by this, it is possible to improve the durability of the L-type film 6*a* and the conveyance coil 5.

On the other hand, according to the result of the experiment examples 2-1 and 2-2, in the thin L-type film 6*a* such as the L-type film 6*a* whose thickness "t" is 0.05 mm, the elastic force of the L-type film itself becomes weak comparing with the L-type film 6*a* whose thickness "t" is 0.1 mm, therefore, it was proved that the force to break up the toner lump 500 adhering to the inner side of the cleaning blade 1 becomes weak, as a result, it is impossible to drop the toner lump 500 completely. Regarding the reason that the paper dirt to the print medium 300 occurs by the toner lump 500 accumulating on the inner side of the cleaning blade 1, it is omitted because it has been already explained in embodiment 1.

The operation of the cleaning device 100*a* of embodiment 2 is the same as the operation of the cleaning device 100 of embodiment 1.

Effect of Embodiment 2

According to the image forming apparatus of embodiment 2 of the present invention, through furnishing the L-type film 6*a* having the plural slits 61*a* along the length direction of the conveyance coil 5 to contact with the circumference of the conveyance coil 5, the L-type film 6 is possible to reduce the load (pressure) providing to the conveyance coil 5 as compared with the L-type film 6 of embodiment 1, by this, it is possible to improve the durability of the L-type film 6*a* and the conveyance coil 5.

Embodiment 3

A cleaning device 100*b* of embodiment 3 of the present invention is obtained by adding a projection 10 for shaking the conveyance coil 5 to the cleaning device 100 of embodiment 1. Thus, through the projection 10 shakes the conveyance coil 5, the L-type film 6 can greatly vibrate by the pressure from the conveyance coil 5. And, an image forming apparatus of embodiment 3 of the present invention is the component having the cleaning device 100*b* stated above.

Figure 8:
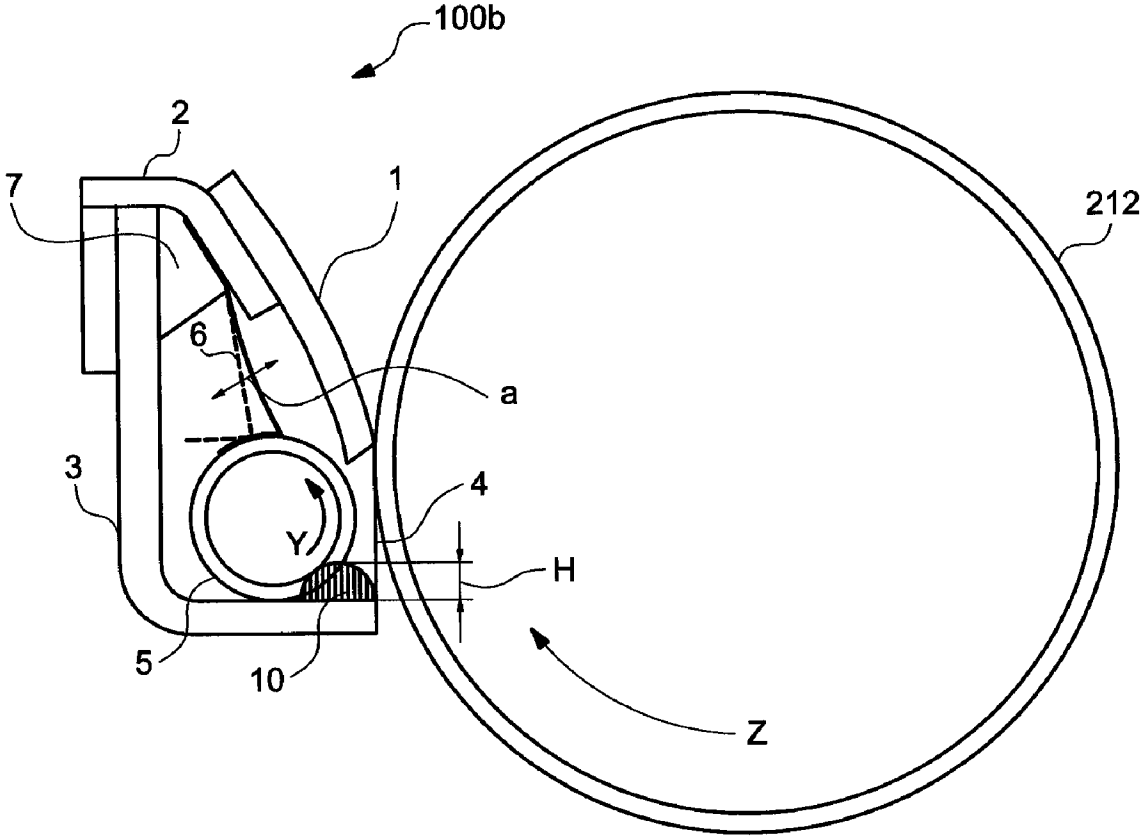
FIG. 8 is a cross section diagram of the front view for showing a structure of a cleaning device in embodiment 3.
Figure 9:
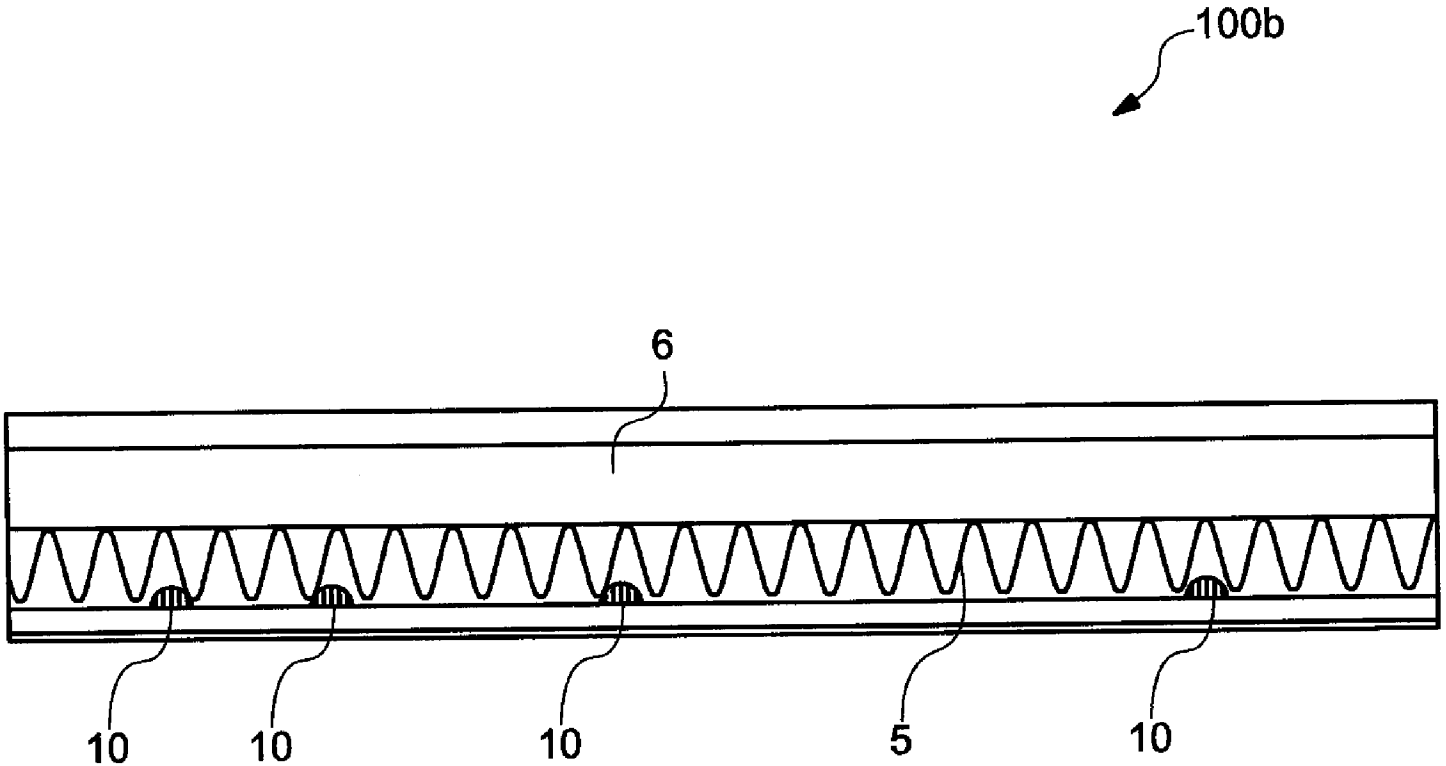
FIG. 9 is a cross section diagram of the side view for showing a structure of a cleaning device in embodiment 3.

The projection 10, as shown by FIG. 8, is furnished in the remainder toner collecting section surrounded by the conveying member cover 3 and the toner leak prevention film 4, and is used for shaking the conveyance coil 5. A plurality of the projections 10, as shown by FIG. 9, are furnished along the length direction of the conveyance coil 5 to contact with the circumference of the conveyance coil 5. Here, in the embodiment 3, in the case that the diameter of the conveyance coil 5 is 5 mm, as shown by FIG. 8, the height H of the projection 10 is set to become 1 mm.

Then, the projection 10, when touching the circumference of the conveyance coil 5 by the rotation of the conveyance coil 5, shakes the conveyance coil 5. Here, the conveyance coil 5, even if slightly vibrating, also can receive rotation force.

The conveyance coil 5 touching the projection 10 and shaking, gives the pressure of the upper direction with respect to the L-type film 6 touching the circumference of the conveyance coil 5.

Figure 10B:
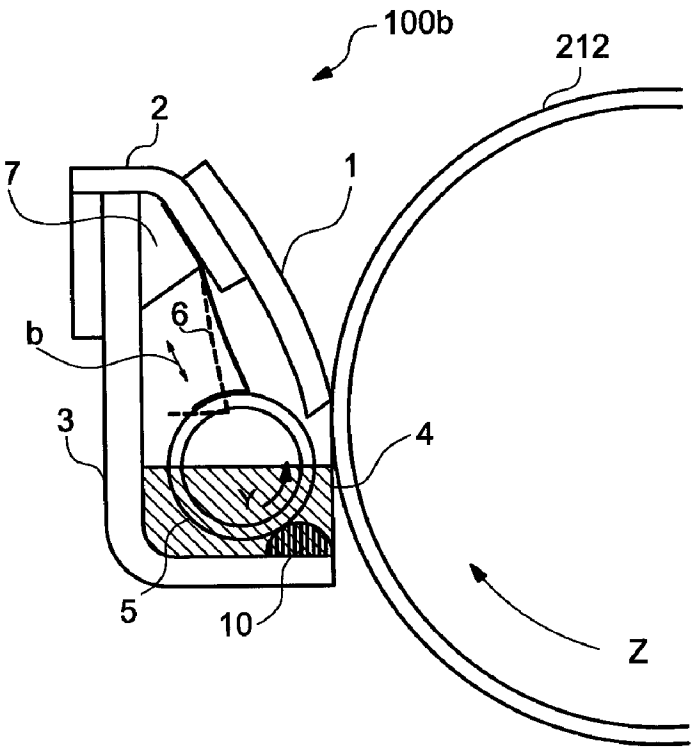
FIG. 10B is a second operation explanation diagram of a L-type film in embodiment 3.
Figure 10A:
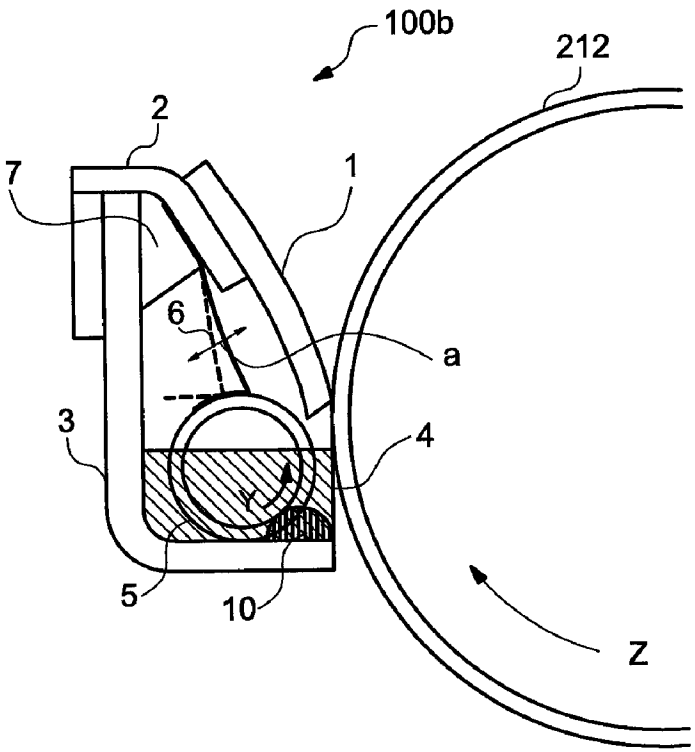
FIG. 10A is a first operation explanation diagram of a L-type film in embodiment 3.

The L-type film 6, when receiving the pressure upwardly outputted from the conveyance coil 5, is lifted upwardly as shown by FIG. 10B so as to minutely vibrate not only along the direction "α" as shown by FIG. 10A, but also along the direction "b". By this, because the L-type film 6 performs two kinds of the minute vibration along the direction "α" and along the direction "b", breaks up the toner lump 500 adhering to the inner side of the cleaning blade 1 by the big elastic force caused by the two kinds of the minute vibration. Here, in the embodiment 3, it is not only formed by using the L-type film 6 of embodiment 1, it is not limited by this, but it can also be formed by using the L-type film 6*a* of embodiment 2.

Moreover, other components are the same as the components of the cleaning device 100 of embodiment 1 and the image forming apparatus 200 having the cleaning device 100.

Regarding the performance evaluation of the cleaning device 100*b* of the embodiment 3 of the present invention, its experiment result is shown in FIG. 11. Here, in the image forming apparatus 200 of embodiment 1, in the image forming apparatus of embodiment 2 and in the image forming apparatus of embodiment 3, the performance evaluation is based on a result of existence/inexistence of the paper dirt in the case that a continuous print of 30 thousands sheets of ordinary paper of A4 is performed in 5% duty (only using the image forming unit 21K having the black toner). Here, as a result of the performance evaluation, in the print process of 20 thousands sheets, 25 thousands sheets and 30 thousands sheets, in the case that the paper dirt is 0 sheet, "○" is stated in the item of "paper dirt" of FIG. 11; and in the case that the paper dirt is at least one sheet, "x" is stated in the item of "paper dirt" of FIG. 11.

In the "comparison example 1" of FIG. 11, the experiment result of the performance evaluation of the image forming apparatus 200 having the cleaning device 100 of the present embodiment 1 is shown. In the image forming apparatus 200, when 20 thousands sheets of the print medium 300 were performed as print process, the paper dirt did not occur, but when 25 thousands sheets of the print medium 300 were performed as print process, the paper dirt occurs.

In the "comparison example 2" of FIG. 11, the experiment result of the performance evaluation of the image forming apparatus having the cleaning device 100*a* of the present embodiment 2 is shown. In the image forming apparatus, when 20 thousands sheets of the print medium 300 were performed as print process, the paper dirt did not occur, but when 25 thousands sheets of the print medium 300 were performed as print process, the paper dirt occurs.

In the "experiment example 3" of FIG. 11, the experiment result of the performance evaluation of the image forming apparatus having the cleaning device 100*b* of the present embodiment 3 is shown. In the image forming apparatus, even if 30 thousands sheets of the print medium 300 were performed as print process, the paper dirt did not occur.

According to the result of the evaluation of the high precision of the comparison example 1, the comparison example 2 and the experiment example 3 stated above, in the image forming apparatus having the cleaning device 100*b* that is the component having the projection 10 of embodiment 3, the projection 10 shakes the conveyance coil 5, the shaken conveyance coil pushes up the L-type film 6 in a upward direction with a strong pressure, therefore, the L-type film 6 greatly vibrates and breaks up the toner lump 500 on the inner side of the cleaning blade 1 with bigger force, by this, it is possible to reduce the occurrence of the paper dirt and to improve the print precision, comparing with the image forming apparatus 200 of embodiment 1 and the image forming apparatus of embodiment 2.

Operation of Embodiment 3

The following is to explain operation of the cleaning device 100*b* of embodiment 3 of the present invention. Here, the bend angle "α" of the tip of the L-type film 6 is set into 90 degrees.

After the toner of the surface of the photosensitive body drum 212 was transferred on the print medium 300, the remainder toner 400 remaining on the surface of the photosensitive body drum 212 is scraped to be removed by the contact force of the cleaning blade 1 contacting with the surface of the photosensitive body drum 212.

The remainder toner 400, when scraped to be removed by the cleaning blade 1, drops to the remainder toner collecting section surrounded by the conveying member cover 3 and the toner leak prevention film 4. However, a part of the remainder toner 400 adheres to the inner side of the cleaning blade 1 and becomes the toner lump 500.

As shown by FIG. 8, when the photosensitive body drum 212 rotates along the direction Z, the conveyance coil 5 rotates along the direction Y through the gear of the photosensitive body drum 212 meshes the gear of the conveyance coil 5, therefore, the conveyance coil 5 conveys the remainder toner 400 that dropped to the remainder toner collecting section toward the direction of the remainder toner conveyance belt 8.

In the remainder toner collecting section stated above, the plural projection 10 that are furnished to contact with the circumference of the conveyance coil, when touching with the circumference of the conveyance coil 5 by the rotation of the conveyance coil 5, shakes the conveyance coil 5.

The conveyance coil 5 touching the projection 10 and shaking, gives the pressure of the upper direction with respect to the L-type film 6 touching the circumference of the conveyance coil 5.

The L-type film 6, when receiving the pressure of the upper direction from the conveyance coil 5, is lifted upwardly as shown by FIG. 10B so as to minutely vibrate not only along the direction "α" as shown by FIG. 10A, but also along the direction "b". By this, because the L-type film 6 performs two kinds of the vibration along the direction "α" and along the direction "b", breaks up the toner lump 500 adhering to the inner side of the cleaning blade 1 by the big bound force caused by the two kinds of the minute vibration.

When the driving roller for driving the remainder toner conveyance belt 8 is rotated by the control of the controlling section (not shown), the remainder toner conveyance belt 8 moves; and introduces the remainder toner 400 that is conveyed from the conveyance coil 5 into the ditch part that is formed on the surface of the remainder toner conveyance belt 8, and moves along the direction where the photosensitive body remainder toner accommodating section 9 is located. Then, the remainder toner 400 conveyed by the remainder toner conveyance belt 8 is held in the photosensitive body remainder toner accommodating section 9.

Effect of Embodiment 3

According to the image forming apparatus of embodiment 3 of the present invention, through the plural projection 10 are furnished to contact with the circumference of the conveyance coil 5, the conveyance coil 5 shakes and pushes upwardly the L-type film 6 contacting with the circumference of the conveyance coil 5. Therefore, not only the L-type film 6 minutely vibrates along the direction "a" as shown by FIG. 10A, but also vibrates along the direction "b" after the L-type film 6 is lifted upwardly as shown by FIG. 10B. By this, the L-type film 6 performs two kinds of vibrations along the direction "a" and along the direction "b". Therefore, the L-type film 6 can break up the toner lump 500 adhering to the inner side of the cleaning blade 1 by the big bound force caused by the two kinds of the minute vibration. By this, it is possible to reduce the occurrence of the paper dirt in the print process and to improve the print control.

In the embodiment stated above, the example is explained to furnish the cleaning device 100 in the image forming unit 21, however, the present cleaning device 100 is not limited by the example, the present invention also can be applied to such toner conveying mechanism, for example, a cleaning device which conveys the remainder toner 400 that adheres to the transfer belt 22 and is scraped to be removed by the cleaning blade 24, or a toner conveying mechanism which conveys new toner through using a conveyance coil. Further, the example is explained to apply the image forming apparatus 200 of the present invention as a printer, but the present invention is not limited by the example, the present invention also can be applied to such device as facsimile, copying machine or MFP (Multi Function Products).

The present invention is not limited to the foregoing embodiments but many modifications and variations are possible within the spirit and scope of the appended claims of the invention.

What is claimed is:

1. A toner conveying mechanism comprising:

a conveying member that rotates to convey toner;

an elastic member configured to contact an outer circumference of the conveying member;

an image carrying body; and a cleaning member disposed between the elastic member and the image carrying body, wherein a portion of the elastic member slidably contacts and moves tangential to the outer circumference of the conveying member during rotation of the conveying member, an entire surface area of the portion of the elastic member which contacts the outer circumference of the conveying member being continuous and uninterrupted.

2. The toner conveying mechanism according to claim 1, wherein the elastic member is formed from film.

3. The toner conveying mechanism according to claim 1, wherein the elastic member includes a supporting portion whose one end is held by a holding member; and a bent portion that has a free end and is bent at a predetermined angle, the bent portion being in contact with the outer circumference of the conveying member and extending away from the cleaning member.

4. The toner conveying mechanism according to claim 3, wherein the bent portion is bent at an angle that is 30 degrees or over or is 150 degrees or less.

5. The toner conveying mechanism according to claim 4, wherein the bent portion is bent at an angle of approximate 90 degrees.

6. The toner conveying mechanism according to claim 3, wherein the elastic member has an elastic force provided by the bent portion and is furnished to contact the circumference of the conveying member.

7. The toner conveying mechanism according to claim 3, wherein the elastic member includes plural holes between the supporting portion and the bent portion.

8. The toner conveying mechanism according to claim 1, wherein a spiral is formed in the conveying member.

9. The toner conveying mechanism according to claim 1, further comprising a collecting section that collects toner, wherein a projection is furnished inside the collecting section to contact an external surface of the conveying member, with a movement of the conveying member.

10. The toner conveying mechanism according to claim 8, further comprising a collecting section that collects toner, wherein a projection is furnished inside the collecting section to intermittently contact the circumference of the conveying member, with a rotation of the conveying member.

11. A cleaning device comprising a toner conveying mechanism, wherein the toner conveying mechanism includes:

a conveying member that rotates to convey toner;

an elastic member configured to contact an outer circumference of the conveying member, an image carrying body; and a cleaning member disposed between the elastic member and the image carrying body, wherein a portion of the elastic member slidably contacts and moves tangential to the outer circumference of the conveying member during rotation of the conveying member, an entire surface area of the portion of the elastic member which contacts the outer circumference of the conveying member being continuous and uninterrupted.

12. The cleaning device according to claim 11, wherein the elastic member is formed from film.

13. The cleaning device according to claim 11, wherein the elastic member includes a supporting portion whose one end is held by a holding member; and a bent portion that has a free end and is bent at a predetermined angle, the bent portion being in contact with the outer circumference of the conveying member and extending away from the cleaning member.

14. The cleaning device according to claim 13, wherein the bent portion is bent at an angle that is 30 degrees or over or is 150 degrees or less.

15. The cleaning device according to claim 13, wherein the elastic member has an elastic force provided by the bent portion and is furnished to contact the circumference of the conveying member.

16. The cleaning device according to claim 13, wherein the elastic member includes plural holes between the supporting portion and the bent portion.

17. The cleaning device according to claim 11, wherein a spiral is formed in the conveying member.

18. The cleaning device according to claim 11, wherein the toner conveying mechanism further includes a collecting section that collects toner, wherein a projection is furnished inside the collecting section to contact an external surface of the conveying member, with a movement of the conveying member.

19. The cleaning device according to claim 17, wherein the toner conveying mechanism further includes a collecting section that collects toner, wherein a projection is furnished inside the collecting section to intermittently contact the circumference of the conveying member, with a rotation of the conveying member.

20. An image forming apparatus, comprising:

a cleaning device comprising:

a toner conveying mechanism, wherein the toner conveying mechanism includes:

a conveying member that rotates to convey toner;

an elastic member configured to contact an outer circumference of the conveying member, an image carrying body; and a cleaning member disposed between the elastic member and the image carrying body, wherein a portion of the elastic member slidably contacts and moves tangential to the outer circumference of the conveying member during rotation of the conveying member, an entire surface area of the portion of the elastic member which contacts the outer circumference of the conveying member being continuous and uninterrupted.

21. The image forming apparatus according to claim 20, wherein the elastic member includes a supporting portion whose one end is held by a holding member and a bent portion that has a free end and is bent at a predetermined angle, the bent portion being in contact with the outer circumference of the conveying member and extending away from the cleaning member.

22. The toner conveying mechanism according to claim 3, wherein the elastic member is configured to alternately move away from and towards the cleaning member with the bent portion being in contact with the outer circumference of the conveying member as the conveying member is rotating.

23. The cleaning device according to claim 13, wherein the elastic member is configured to alternately move away from and towards the cleaning member with the bent portion being in contact with the outer circumference of the conveying member as the conveying member is rotating.

24. The image forming apparatus according to claim 21, wherein the elastic member is configured to alternately move away from and towards the cleaning member with the bent portion being in contact with the outer circumference of the conveying member as the conveying member is rotating.

* * * * *